US005337534A

United States Patent [19]

Nasca

[11] Patent Number: 5,337,534

[45] Date of Patent: Aug. 16, 1994

[54] REVERSIBLE FOUNDATION BOLT HOLDER

[76] Inventor: Gerald Nasca, 8322 Chester Dr., Sacramento, Calif. 95830

[21] Appl. No.: 967,981

[22] Filed: Oct. 28, 1992

[51] Int. Cl.[5] ..... E04B 1/00; E04G 21/00

[52] U.S. Cl. ..... 52/745.21; 52/295; 52/699; 249/93

[58] Field of Search ..... 52/295, 699, 700, 703, 52/DIG. 1, 745.21; 249/93, 207

[56] References Cited

U.S. PATENT DOCUMENTS

| | | | |
|---|---|---|---|
| 896,330 | 8/1908 | Scheelky | 249/93 |
| 1,924,724 | 8/1933 | Olney . | |
| 2,163,808 | 6/1939 | Pithoud . | |
| 2,289,604 | 7/1942 | Cott et al. | 52/295 X |
| 2,691,293 | 10/1954 | Patterson . | |
| 2,772,560 | 12/1956 | Neptune . | |
| 2,911,702 | 11/1959 | Clyncke | 249/207 |
| 3,126,928 | 3/1964 | McMillan . | |
| 3,150,429 | 9/1964 | Shaffer . | |
| 3,163,909 | 1/1965 | Williams . | |
| 3,377,763 | 4/1968 | Beckman . | |
| 3,458,184 | 7/1969 | Schlosser . | |
| 3,469,815 | 9/1969 | Brenneman . | |
| 3,490,760 | 1/1970 | Nill . | |
| 3,552,734 | 1/1971 | Severino | 52/699 X |
| 3,912,218 | 10/1975 | Lister . | |
| 3,960,356 | 6/1976 | Adams . | |
| 3,964,219 | 6/1976 | Hala . | |
| 4,000,591 | 1/1977 | Courtois . | |
| 4,202,149 | 5/1980 | Betrue, Sr. . | |
| 4,261,544 | 4/1981 | Addison | 249/93 |
| 4,412,407 | 11/1983 | Melfi et al. | 52/699 |
| 4,524,553 | 6/1985 | Hacker . | |
| 4,640,063 | 2/1987 | Ayala . | |
| 4,641,478 | 2/1987 | Nelson, Jr. | 52/700 X |
| 4,671,483 | 6/1987 | Harbeke . | |
| 4,736,554 | 4/1988 | Tyler . | |
| 4,790,509 | 12/1988 | Cardwell et al. . | |
| 5,002,446 | 3/1991 | Anderson | 52/DIG. 1 X |
| 5,060,436 | 10/1991 | Delgado, Jr. | 52/295 |

FOREIGN PATENT DOCUMENTS 2632717 1/1978 Fed. Rep. of Germany .

*Primary Examiner*—Rodney M. Lindsey
*Attorney, Agent, or Firm*—Bernhard Kreten

[57] ABSTRACT

A reversible foundation bolt holder is provided which has two separate grasping means. Each grasping means can either straddle a form adjacent a building foundation requiring a foundation bolt or may support the foundation bolt above the foundation by placement of the foundation bolt through holes therein. The two grasping means are oriented perpendicular to each other. The holes within each grasping means are of different sizes corresponding to different sized foundation bolts. The holes of each grasping means are located such that they will properly position a foundation bolt in the center of mudsills of varying dimensions. The foundation bolt holder thus has two operative orientations. One orientation locates the first grasping means straddling the form and the second grasping means supporting the foundation bolt. The second orientation locates the second grasping means straddling the form and the first grasping means supporting the foundation bolt.

21 Claims, 5 Drawing Sheets

10
120
130
71
70
74
78
76
73
72
110
82
60
80
182
180
171
170
172
174
178
176
173
160
161
162
164
163
61
62
64
63

REVERSIBLE FOUNDATION BOLT HOLDER

FIELD OF THE INVENTION

The following invention relates generally to devices which facilitate effective placement of foundation bolts within building foundations. More particularly, this invention relates to foundation bolt holders which suspend from forms adjacent the foundation and support the foundation bolt securely in position while cementitious material is placed around and hardened to the foundation bolt.

BACKGROUND OF THE INVENTION

Foundation bolts are often used in the construction industry as a preferred way to secure a mudsill to a concrete foundation of a building. Whether the building has a concrete slab or merely has a concrete foundation along a periphery of the building, it is desirable to have foundation bolts (also known as anchor bolts) protruding upwardly from the concrete or other cementitious material such that the mudsill may be bolted directly to the foundation.

Many devices are available in the prior art which support foundation bolts while a concrete foundation is hardening. These prior art foundation bolt holders suffer from a variety of deficiencies. Some foundation bolt holders provide no means to adequately prevent the foundation bolt from skewing at an angle away from perpendicular to the upper surface of the foundation. Other foundation bolt holders are limited in that they are only sized for mudsills and foundation bolts of specific dimensions. Many foundation bolt holders are not easily removed from the concrete foundation after hardening, thus inhibiting their reuse in other locations. Finally, many foundation bolt holders must be suspended between two forms. These bolt holders are ineffective where a concrete slab is poured as part of the foundation.

The device of this invention provides a foundation bolt holder which is easily placeable and removable onto forms supporting the hardening cementitious material. It prevents the foundation bolt from skewing to an angle away from perpendicular to an upper surface of the foundation, and it easily accommodates bolts and mudsills of various dimensions.

The following prior art reflects the state of the art of which applicant is aware and is included herewith to discharge applicant's acknowledged duty to disclose relevant prior art. It is stipulated, however, that none of these references teach singly nor render obvious when considered in any conceivable combination the nexus of the instant invention as disclosed in greater detail hereinafter and as particularly claimed.

| INVENTOR | PATENT NO. | ISSUE DATE |
|---|---|---|
| Olney, H. B. | 1,924,724 | August 29, 1933 |
| Pithoud, M. A. | 2,163,808 | June 27, 1939 |
| Patterson, F. L. | 2,691,293 | October 12, 1954 |
| Neptune, H. P. | 2,772,560 | December 4, 1956 |
| McMillan, A. L. | 3,126,928 | March 31, 1964 |
| Shaffer, D. H. | 3,150,429 | September 29, 1964 |
| Williams, H. M. | 3,163,909 | January 5, 1965 |
| Beckman, M. H. | 3,377,763 | April 16, 1968 |
| Schlosser, F. G. | 3,458,184 | July 29, 1969 |
| Brenneman, J. H. | 3,469,815 | September 30, 1969 |
| Nill, W. | 3,490,760 | January 20, 1970 |
| Lister, G. F. | 3,912,218 | October 14, 1975 |
| Adams, J. H. | 3,960,356 | June 1, 1976 |

-continued

| INVENTOR | PATENT NO. | ISSUE DATE |
|---|---|---|
| Hala, A. A. | 3,964,219 | June 22, 1976 |
| Courtois, P. D. | 4,000,591 | January 4, 1977 |
| Betrue, Sr., N. A. | 4,202,149 | May 13, 1980 |
| Melfi, S. T. | 4,412,407 | November 1, 1983 |
| Hacker, J. H. | 4,524,553 | June 25, 1985 |
| Ayala, H. | 4,640,063 | February 3, 1987 |
| Harbeke, G. J. | 4,671,483 | June 9, 1987 |
| Tyler, K. W. | 4,736,554 | April 12, 1988 |
| Cardwell et al. | 4,790,509 | December 13, 1988 |
| Kettner, R. | DE 26 32 717 | January 26, 1978 |

The patent to Shaffer teaches the use of a cement anchor bolt gauge which is capable of supporting an anchor bolt during the hardening of the cement. The device of Shaffer suspends from a form supporting the concrete. The invention of this application is distinguishable from Shaffer in that this invention accommodates various bolt sizes and bolt locations in a single foundation bolt holder and also the device of this invention is able to straddle the form without necessitating attachment thereto with devices such as nails.

The patent to Adams teaches the use of an anchor bolt holder which supports an anchor bolt within cementitious material during hardening. The device taught by Adams is suspended from forms which bound both sides of a concrete foundation. The invention of this application is distinguishable from Adams in that it is utilizable both where a narrow concrete foundation is being formed and also where a concrete slab of substantial width is being formed. Furthermore, the invention of this application does not require attachment devices such as nails to hold it securely to the forms.

The patent to Schlosser teaches the use of an aligner for anchor bolts which is suspended over both sides of a form which supports concrete filling a region therebetween which is hardening. The invention of this application is distinguishable from Schlosser in that it is suspendable from a single form on one side of a region containing hardening concrete. It does not require placement adjacent to both sides of a form bounding a region of hardening concrete.

The remainder of the prior art listed above diverge even more starkly from those references specifically distinguished above.

SUMMARY OF THE INVENTION

The reversible foundation bolt holder is a rigid unitary mass having two U-shaped supports with a node interposed therebetween. Each U-shaped support has two parallel plates spaced apart with an orthogonol plate interposed therebetween at ends of the two parallel plates adjacent to the node. Thus, the two parallel plates and the orthogonol plate, when viewed together, have a U-shaped cross-section. The two U-shaped supports are oriented with orthogonol plates of each U-shaped support perpendicular to each other.

An axis of symmetry exists between each corresponding part of each U-shaped support. The foundation bolt holder is substantially symmetrical about this axis of symmetry.

The parallel plates of each U-shaped support are configured both to straddle a form which is oriented to support hardening cementitious material, and also to have holes therein which pass through each parallel plate along a line perpendicular to the parallel plates. The pairs of holes are sized to receive foundation bolts therethrough. The locations of the holes correspond to distances from the orthogonol plates at which foundation bolts are to be located. Thus, when the bolt holder is oriented with one of the U-shaped supports straddling the form, the other U-shaped support has its two parallel plates parallel to a top surface of the hardening cementitious material and perpendicular to the form supporting the cementitious material.

Pairs of holes in the U-shaped support which are not straddling the form are oriented to position the foundation bolt within the cement in a variety of different locations. The pair of holes which is utilized to support the foundation bolt is that pair which would place the foundation bolt in a location desired to attach the mudsill to the foundation. The pairs of holes of each U-shaped support are of varying sizes. Thus, the user orients the bolt holder such that the U-shaped support having the desired holes extends over the cementitious material and the other U-shaped support straddles the form.

Once the cementitious material has hardened, the foundation bolt holder is removable by removing a nut from the foundation bolt and utilizing a lever between the form and the orthogonol plate of the U-shaped support which is straddling the form. The foundation bolt holder may then be reused on another foundation. Ribs on each orthogonol plate support the orthogonol plate slightly above a top surface of the form allowing the lever to be easily placed between the orthogonol plate and the form. The node between the two U-shaped supports includes a gusset interposed perpendicular to each of the orthogonol plates of each U-shaped support and a ridge extending around a periphery of the gusset. The ridge facilitates easy handling of the foundation bolt holder by a user.

Nail holes are provided in one of the parallel plates of each U-shaped support so that the foundation bolt holder may be securely attached to the form if desired.

OBJECTS OF THE INVENTION

Accordingly, it is a primary object of the present invention to provide a reversible foundation bolt holder having at least two grasping means, each grasping means having both means to straddle a form supporting hardening cementitious material and means to support a foundation bolt within the hardening cementitious material, such that the two grasping means may swap places interchangeably.

Another primary object of the present invention is to provide a foundation bolt holder which is utilizable on foundations where only a single form is available for attachment of the foundation bolt holder.

Another further object of the present invention is to provide a foundation bolt holder having means to support the foundation bolt at various distances away from a form supporting hardening cementitious material, the positions corresponding with half-widths of various mudsills to be anchored by the foundation bolts.

Another further object of the present invention is to provide a foundation bolt holder having holes for supporting foundation bolts of various different diameters without changing the location that the foundation bolts have with respect to the form.

Another further object of the present invention is to provide a foundation bolt holder which supports the foundation bolts in a manner preventing the foundation bolts from skewing to an angle non-perpendicular to a top surface of the concrete foundation.

Another further object of the present invention is to provide a foundation bolt holder which is easily locatable and removeable with respect to a form supporting hardening cementitious material.

Another further object of the present invention is to provide a foundation bolt holder having a durable rigid construction.

Another further object of the present invention is to provide a foundation bolt holder which lends itself to easy manufacture from a variety of materials.

Viewed from a first vantage point it is an object of the present invention to provide a reversible foundation bolt holder comprised of a first grasping means including a means to releasably grasp a form supporting cementitious material, and a second grasping means connected to the first grasping means and includes a means to releasably grasp a foundation bolt in an orientation desired to anchor the foundation bolt within the cementitious material; wherein the first grasping means and the second grasping means are separated by an axis of symmetry such that the first grasping means and the second grasping means appear as mirror images of each other from an end view thereof; and wherein said first grasping means includes means to releasably grasp a foundation bolt and the second grasping means includes means to grasp the form; whereby the foundation bolt holder is reversible through pivoting about the axis of symmetry.

Viewed from a second vantage point it is an object of the present invention to provide an apparatus for supporting a foundation bolt in place within cementitious material of a building foundation during hardening thereof comprised of a first straddle means mounting said bolt holder to a form supporting the cementitious material, and a first support means connected to the first straddle means supporting the foundation bolt in an orientation extending out of the cementitious material.

Viewed from a third vantage point it is an object of the present invention to provide a method for supporting foundation bolts of various diameters in various orientations with respect to a form bounding cementitious material with a single foundation bolt support including the steps of: providing a supporting device having at least two grasping means, each grasping means both supportable on the form by straddling the form and having holes to support foundation bolts in various vertical orientations away from the form, sizing the holes of a first grasping means differently from holes of a second grasping means, locating the holes of each grasping means at a plurality of different distances away from the form which correspond to commonly desired foundation bolt orientations, placing the supporting device adjacent the form with one grasping means having undesirable hole sizes straddling the form and a second grasping means having hole sizes to be utilized depending over the cementitious material, selecting a hole in the second grasping means having a location above a desired foundation bolt affixation location, and placing the foundation bolt into the hole chosen in said selecting step.

Viewed from a fourth vantage point it is an object of the present invention to provide a method for forming a foundation from which a foundation bolt projects, such that the bolt is in registry with a mudsill to be replaced on the foundation and over the bolt, the steps including: forming a bolt holder with a first form board grasping means and with a cantilevered portion which projects over an area which is to receive cementitious material, the cantilevered portion having holes therein for receiving foundation bolts, selecting between one of two mudsill width sizes for the foundation; selecting between one of two foundation bolt sizes for the foundation; orienting the foundation bolt through holes corresponding to the size of the foundation bolt and directly over a location central to a width of the mudsill selected in said selecting step, and placing the first form board grasping means upon the form board.

These and other objects will be made manifest when considering the following detailed specification when taken in conjunction with the appended drawing figures.

BRIEF DESCRIPTION OF THE DRAWING FIGURES

DESCRIPTION OF PREFERRED EMBODIMENTS

Figure 1:
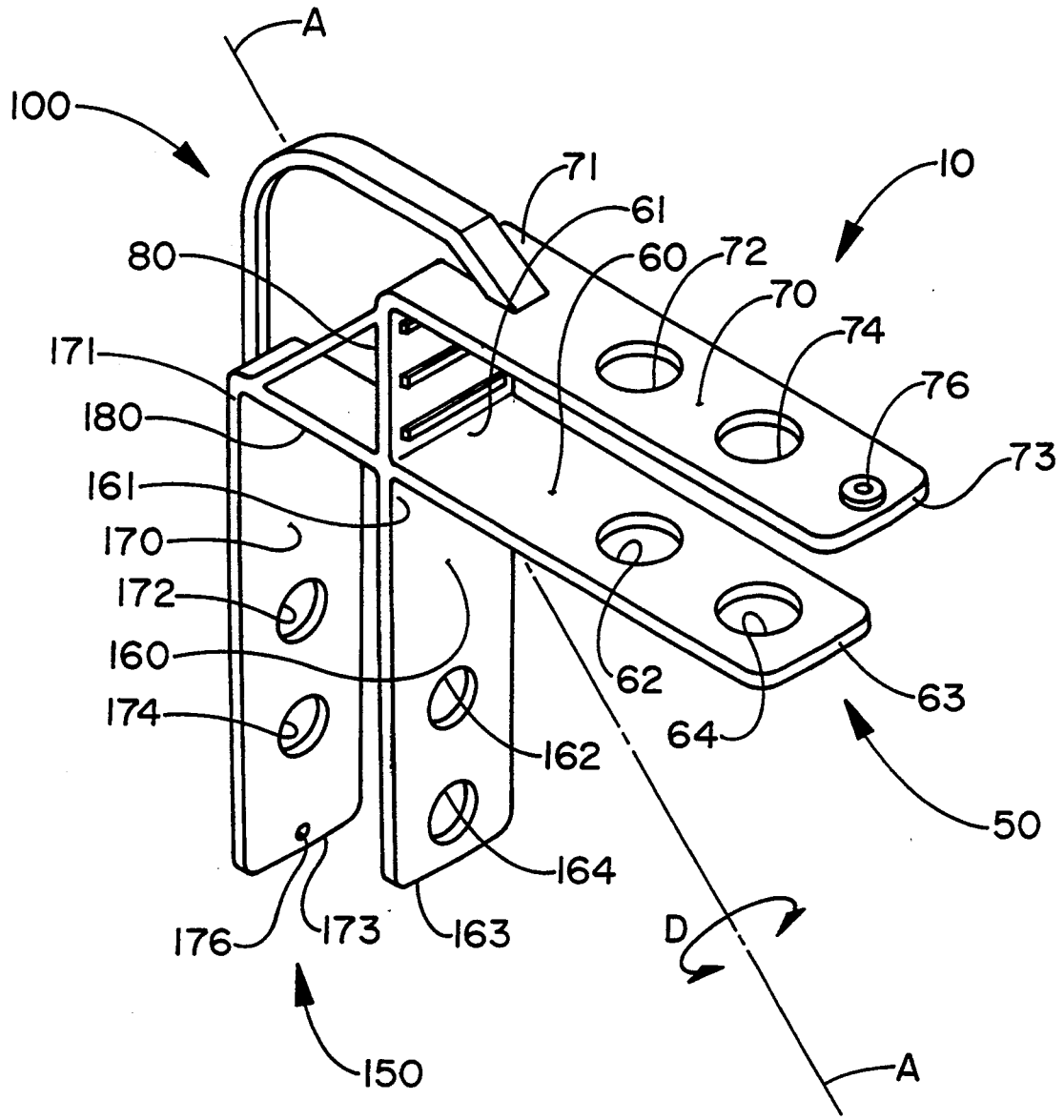
FIG. 1 is an isometric view of the device of this invention separated from its intended environment.

Considering the drawings, wherein like reference numerals denote like parts throughout the various drawing figures, reference numeral 10 is directed to a reversible foundation bolt holder. The bolt holder 10 is utilizable to support a foundation bolt B within cementitious material C, such as that utilized in a building foundation. The foundation bolt holder 10 is supportable upon a form F supporting the cementitious material C during hardening thereof.

In its essence, the reversible foundation bolt holder 10 (shown in FIGS. 1 through 3 and 5 through 9) is a rigid unitary mass including a first U-shaped support 50 and a second U-shaped support 150. The two U-shaped supports 50, 150 have substantially identical construction. A node 100 is interposed between the first U-shaped support 50 and the second U-shaped support 150. Each U-shaped support 50, 150 includes two parallel plates spaced apart. The parallel plates of the first U-shaped support 50 include a proximal leg 60 and a distal leg 70. The two parallel plates of the second U-shaped support 150 include a proximal prong 160 and a distal prong 170. The two parallel plates of each U-shaped support 50, 150 are spaced apart a distance substantially equal to a common width of form boards F utilized in supporting cementitious material C during hardening thereof. Both of the U-shaped supports 50, 150 may thus straddle the form F.

Each parallel plate of each U-shaped support 50, 150 includes a plurality of holes therein sized to receive foundation bolts B of various sizes. The holes of each U-shaped support 50, 150 are oriented such that when one of the U-shaped supports 50, 150 is straddling the form F, the other U-shaped support 50, 150 has its holes oriented to position the foundation bolt B in an orientation substantially parallel to the form F and substantially perpendicular to a top surface of the hardening cementitious material C. The two U-shaped supports 50, 150 have substantially identical cross-sections causing the reversible foundation bolt holder 10 to display bilaterally symmetrical characteristics between opposite sides of an axis of symmetry A.

More particularly, and referring to FIGS. 1 and 5 through 9, the reversible foundation bolt holder 10 includes a first U-shaped support 50 and a second U-shaped shaped support 150 with a node 100 interposed therebetween. The first U-shaped support 50 includes two parallel rectangular plates including a proximal leg 60 and a distal leg 70.

The proximal leg 60 has an attached end 61 adjacent the node 100 and a free end 63 on an end of the proximal leg 60 opposite the attached end 61. Likewise, the distal leg 70 has an attached end 71 adjacent the node 100 and a free end 73 on an end of the distal leg 70 opposite the attached end 71.

A bight portion 80 is interposed orthogonally between attached ends 61, 71 of the two legs 60, 70. The bight portion 80 defines a boundary between the node 100 and the first U-shaped support 50. The bight portion 80 separates the two legs 60 of the U-shaped support 50 a distance substantially equal to a horizontal thickness of a form board F (see FIG. 2) which is used to support cementitious material C (FIGS. 3 and 4) during hardening thereof. Forms F of this nature are often of a standard thickness slightly less than two inches. Preferably, the distance between the two legs 60 conforms to this dimension. The two legs 60, 70 can thus easily straddle the form F with the distal leg 70 on one side of the form F and the proximal leg 60 on an opposite side of the form F.

The proximal leg 60 includes a first hole 62 and a second hole 64, each passing entirely therethrough. Likewise, the distal leg 70 has a first hole 72 and a second hole 74 passing entirely therethrough. The two first holes 62, 72 are oriented such that a line passing through centers of the two first holes 62, 72 is oriented orthogonal to the two legs 60, 70 for reasons which will become apparent. Likewise, the two second holes 64, 74 are similarly oriented to the two first holes 62, 72 except that they are located at a location closer to the free ends 63, 73. Each of the holes 62, 64, 72, 74 are sized to receive a foundation bolt B passing therethrough.

Preferably, each of the holes 62, 64, 72, 74 is of a similar size adapted to receive the foundation bolt B having a specific diameter. Alternatively, certain of the holes 62, 64, 72, 74 could be of varying diameters to conform to the diameters of various sized foundation bolts. The two legs 60, 70 and their holes 62, 64, 72, 74 together form a first grasping means. This first grasping means is thus capable of either straddling a form F (FIG. 2) or supporting a foundation bolt B (FIG. 3) passing through either the first holes 62, 72 or the second holes 64, 74.

Figure 2:
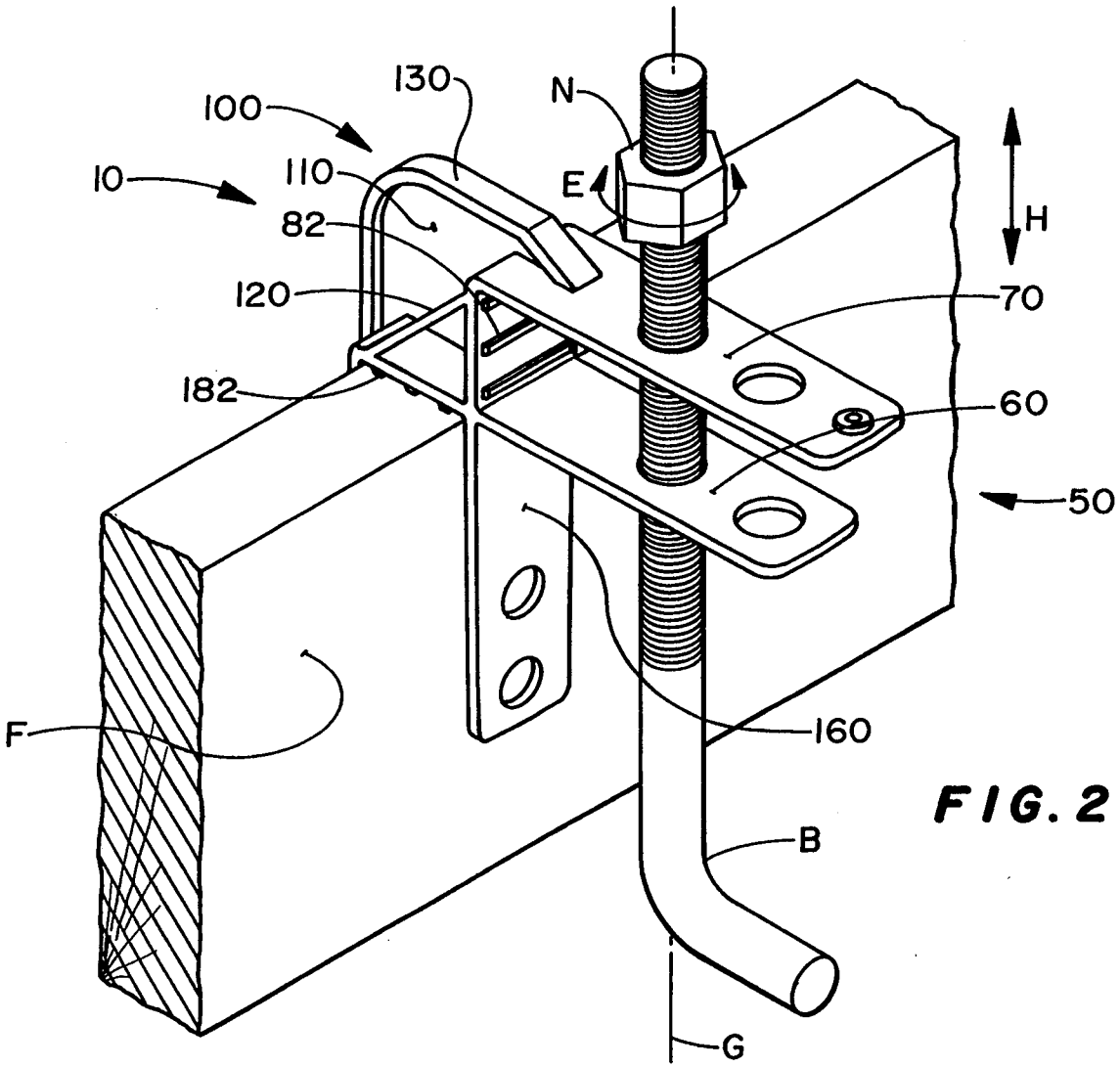
FIG. 2 is an isometric view of the device of this invention in place upon a foundation form board with a foundation bolt located therein.

An anti-skew means is defined by the two holes 62, 72 or the two holes 64, 74. These hole pairs support the bolt B in an orientation colinear with an axis of bolt alignment G (FIG. 2). The axis of bolt alignment G is preferably oriented perpendicular to an upper surface of the foundation and parallel to the form F.

The two first holes 62, 72 are oriented a distance away from the bight portion 80 equal to one-half of a width of a mudsill M (see FIG. 4) such that a bolt which is oriented within the first hole 62, 72 will be properly located centrally through the mudsill M, after the cementitious material C hardens and the mudsill M is in place. The two second holes 64, 74 are located a distance away from the bight portion 80 equal to one-half of a width of a mudsill (not shown) having a width greater than the mudsill M.

The exact hole 62, 64, 72, 74 locations are selected to conform to dimensions of materials commonly used in the construction industry. Common widths of mudsills include approximately 4-inch width mudsills M and 6-inch width mudsills. Accordingly, a preferable location of the first holes 62, 72 is approximately 1.5 inches from the bight portion 80 and a preferable distance of the second holes 64, 74 from the bight portion 80 is approximately 2 inches.

A nail hole 76 passes entirely through the distal leg 70 near the distant end 73 of the distal leg 70. The nail hole 76 is circumscribed by an annular hump 78 which is raised above a surface of the distal leg 70 opposite the proximal leg 60. The hump 78 prevents a nail from tearing out of the nail hole 76. The distal leg 70 is slightly longer than the proximal leg 60 such that a nail (not shown) passing through the nail hole 76 perpendicular to the distal leg 70 will not impact the proximal leg 60. When the first U-shaped support 50 is located straddling the form F (FIG. 3), a nail may be placed through the nail hole 76 and driven into the form F. While a nail is not necessary for utilization of the bolt holder 10, the nail can provide additional stability for the bolt holder 10 and prevent the bolt holder 10 from becoming dislodged from a desired location.

Figure 3:
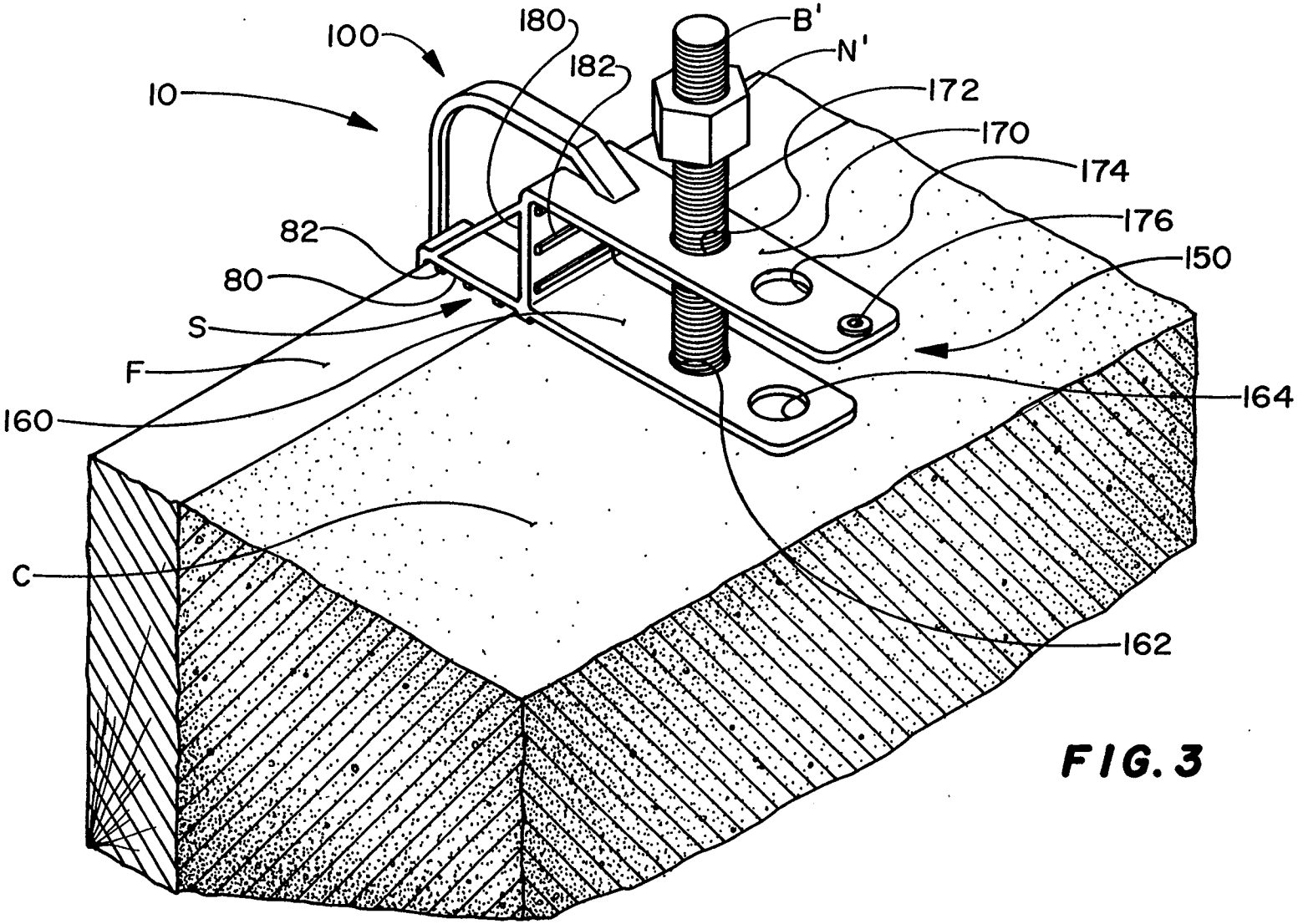
FIG. 3 is an isometric view of the device of this invention having been pivoted into a different orientation and after a foundation of cementitious material has been poured.
Figure 4:
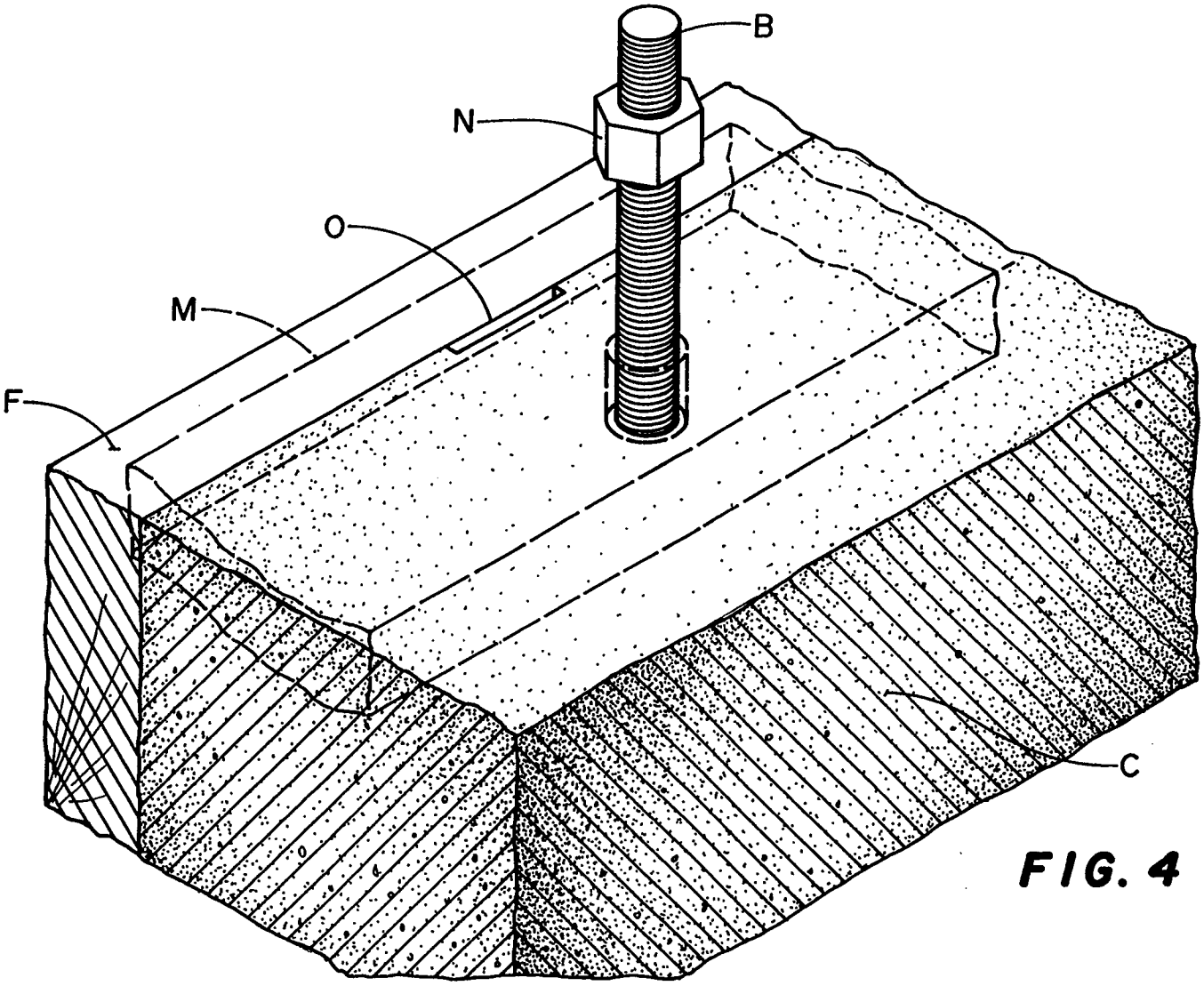
FIG. 4 is an isometric view of the environment surrounding the device of this invention after the device of this invention has been utilized and removed from the environment.
Figures 5, 6, 7, 8, 9:
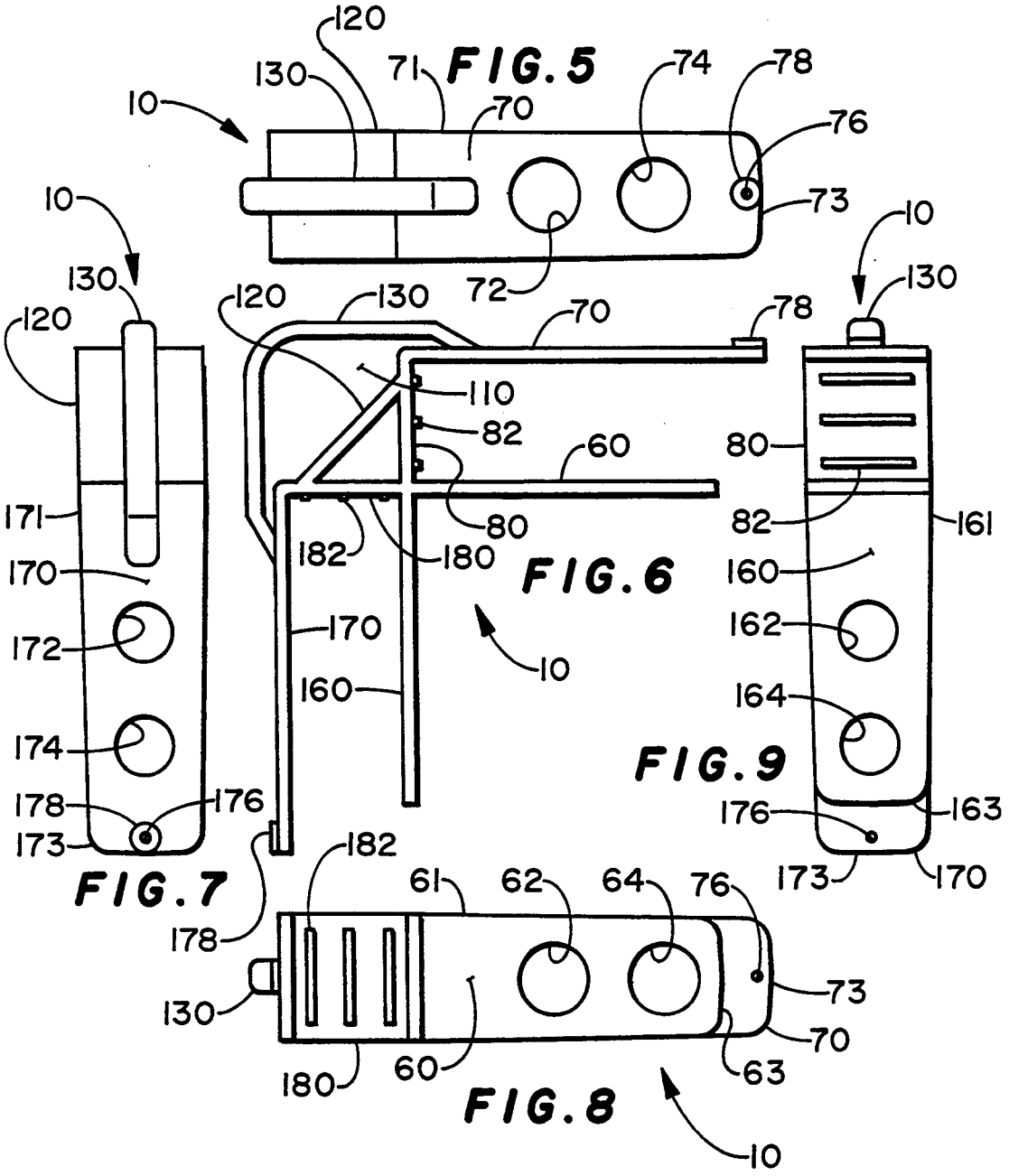
FIG. 5 is a top view of that which is shown in FIG. 6.
FIG. 6 is a front view of the device of this invention.
FIG. 7 is a left side view of that which is shown in FIG. 6.
FIG. 8 is a bottom view of that which is shown in FIG. 6.
FIG. 9 is a right side view of that which is shown in FIG. 6.

A plurality of ribs 82 (FIG. 2) are attached to the bight portion 80 on a side thereof adjacent to the legs 60, 70. The ribs 82 are oriented in planes parallel to the proximal leg 60 and the distal leg 70. Each rib 82 is essentially an elongate tetragonal construct attached to the bight portion 80 along a long surface of the rib 82. Preferably, three ribs 82 are oriented within three separate parallel planes interposed between the proximal leg 60 and the distal leg 70. The ribs 82 elevate the first U-shaped support 50 slightly above a top surface of the form F when the first U-shaped support 50 is straddling the form F (FIG. 3). The ribs 82 thus provide space S between the bight portion 80 and a top surface of the form F.

This space S facilitates the insertion of a lever (not shown) between the bight portion 80 and the form F so that the bolt holder 10 may be pried off of the form F and away from the cementitious material C after hardening of the cementitious material C. The ribs 82 are preferably positioned such that separate claws of a claw hammer or other similarly configured crowbar (not shown) may be utilized as a lever under the bight portion 80 and between the ribs 82.

An axis of symmetry A is definable which passes through the reversible foundation bolt holder 10, as shown in FIG. 1. Details of the reversible foundation bolt holder 10 on a side of the axis of symmetry A including the first U-shaped support 50 are substantially mirrored by details of the reversible foundation bolt holder 10 on an opposite side of the axis symmetry A. Accordingly, a second U-shaped support 150 having features substantially similar to the features of the first U-shaped support 50 is fixedly attached to the node 100 on a side of the axis of symmetry A opposite the location of the first U-shaped support 50.

The second U-shaped support 150 (FIGS. 1, 3 and 5 through 9) includes a proximal prong 160 and a distal prong 170 having structure similar to the legs 60, 70 of the first U-shaped support 50. The two prongs 160, 170 are parallel to each other but substantially perpendicular to the two legs 60, 70. Accordingly, the second U-shaped support 150 is oriented perpendicular to the first U-shaped support 50. The two prongs 160, 170 have attached ends 161, 171 adjacent the node 100 and free ends 163, 173 distant from the node 100.

A crotch 180 is oriented perpendicularly between the two prongs 160, 170 at the attached ends 161, 171. The crotch 180 is similar in construction to the bight portion 80 and thus forms a border between the node 100 and the second U-shaped support 150. The crotch 180 includes ribs 182 attached thereto in a manner similar to the attachment of the ribs 82 to the bight portion 80. The ribs 182 elevate the second U-shaped support 150 above a top surface of the form F when the second U-shaped support 150 is straddling the form F (FIG. 2).

The proximal prong 160 includes a first orifice 162 and a second orifice 164 and the distal prong 70 includes a first orifice 172 and a second orifice 174. Each orifice is similar to the holes 62, 64, 72, 74 of the first U-shaped support 50 except that their diameters preferably differ. The two first orifices 172, 162 are spaced a distance away from the crotch 180 similar to the distance between the first holes 62, 72 and the bight portion 80. A distance between the second orifices 164, 174 and the crotch 180 is preferably substantially equal to a distance between the second holes 64, 74 and the bight portion 80.

Preferably, each of the orifices 162, 164, 172, 174 is of similar diameter, that diameter being different from a diameter of the holes 62, 64, 72, 74. The orifices 162, 164, 172, 174 have diameters similar to a diameter of a foundation bolt B' (FIG. 3) having a different diameter than the foundation bolt B (FIG. 2). Thus, when the first U-shaped support 50 is straddling the form F, orifices 162, 164, 172, 174 of the second U-shaped support 150 are oriented to support a foundation bolt B' with an included nut N'. When the second U-shaped support 150 is straddling the form F, holes 62, 64, 72, 74 of the first U-shaped support 50 are oriented to support a foundation bolt B having a diameter which differs from a diameter of the foundation bolt B'.

A nail orifice 176 and annular hump 178 are oriented on the distal prong 170 in an orientation which mirrors the orientation of the nail hole 76 and the annular hump 78 of the distal leg 70.

The node 100 is positioned straddling the axis of symmetry A and interposed between the first U-shaped support 50 and the second U-shaped support 150. The node 100 includes a gusset 110 which is a planar wall of substantially square construction which is oriented in a plane both perpendicular to the legs 60, 70 and the prongs 160, 170. The gusset 110 is positioned a median distance between sides of the prongs 160, 170 and the legs 60, 70. The gusset 110 is slightly wider in dimension than a length of the bight portion 80 and the crotch 180. A corner of the gusset most distant from the two supports 50, 150 is slightly rounded. Portions of the gusset 110 adjacent the distal leg 70 and the distal prong 170 extend slightly beyond the bight portion 80 and the crotch 180 on a surface of the leg 70 opposite from the proximal leg 60 and a surface of the prong 170 opposite from the proximal prong 160.

A ridge 130 circumscribes a periphery of the gusset 110 between the distal leg 70 and the distal prong 170 and is oriented in a plane which remains perpendicular to surfaces of the gusset 110. The gusset 110 and ridge 130 together provide a surface which is easily graspable by the hand of a user for translation of the reversible foundation bolt holder 10.

A diagonal truss 120 forms a support wall within the node 100. The diagonal truss 120 is oriented in a plane perpendicular to the gusset 110 and perpendicular to the axis of symmetry A. The diagonal truss 120 extends between the bight portion 80 and the crotch 180. The diagonal truss 120 attaches to the bight portion 80 near a junction between the bight portion 80 and the distal leg 70. The diagonal truss 120 attaches to the crotch 180 near a junction between the crotch 180 and the distal prong 170. The diagonal truss 120 provides additional structural strength to the bolt holder 10 providing the bolt holder 10 with a more rigid durable construction.

In use and operation, the reversible foundation bolt holder 10 is utilized in the following manner. Initially, a user selects the width of mudsill M to be utilized in construction of the building. The user then selects a foundation bolt B (or B') with a desired diameter for attachment of the mudsill M to the cementitious material C forming the foundation. The user then erects the form boards F in locations surrounding the desired location for the foundation and also selects the locations at which the user desires to locate foundation bolts B. The user then places the bolt holder 10 upon the form F with one of the supports 50, 150 straddling the form F.

If the holes 62, 64, 72, 74 or orifices 162, 164, 172, 174, which are exposed over the foundation location are of the wrong size and fail to tightly receive the bolts B, B' therethrough, the user removes the bolt holder 10 from the form F and rotates the bolt holder 10 about arrow D (FIG. 1) approximately 180°. The user then replaces the bolt holder 10 upon the form F. The user is then provided with holes 62, 64, 72, 74 or orifices 162, 164, 172, 174 opposite those which the user was originally presented with. Preferably, the user determines which holes or orifices are desired for support of the foundation bolt B, B' originally and utilizes the support 50, 150 having the unutilized holes or orifices to straddle the form F.

Assume that the user selects foundation bolt B. The bolt B is placed within the holes 62, 72 (or 64, 74) by removing a nut N from the bolt B and placing the foundation bolt B up through the holes 62, 72 (along arrow G of FIG. 2), first through the proximal leg 60 and then through the distal leg 70. The nut N is then replaced upon the bolt B above the distal leg 70. The nut N is locatable along the bolt B by rotation thereof about arrow E (FIG. 2). Preferably, the nut N is located on the bolt B at a location which orients the bolt B precisely at a depth desired within the cementitious material C when the nut N is adjacent an upper surface of the distal leg 70. FIG. 2 reveals the bolt B in position for pouring of the cementitious material C except that the nut N has not yet been fully adjusted to reside adjacent the leg 70.

The cementitious material is then poured. As the cementitious material C hardens the bolt B is suspended from the distal leg 70 by having the nut N resting upon the distal leg 70. Once the cementitious material C hardens, the foundation bolt holder 10 is removable by unthreading the nut N, through rotation about arrow E, and then lifting the bolt holder 10 away from the bolt B and the form F by translation in a direction along arrow H. The proximal prong 160 causes an opening 0 within the cementitious material C.

The bolt holder 10 may adhere somewhat to the cementitious material C. In this situation, a lever (not shown) may be placed between the form F and the crotch 180 with forks of the lever interposed between the ribs 182. By providing force to the lever, the bolt holder 10 may be removed from the form F and the cementitious material C. A mudsill M may then be placed over the foundation bolt B and the nut replaced upon the foundation bolt B (see FIG. 4). The bolt holder 10 may then be easily reused in the construction of a foundation of another building.

Moreover, having thus described the invention, it should be apparent that numerous structural modifications and adaptations may be resorted to without departing from the scope and fair meaning of the instant invention as set forth hereinabove and as described hereinbelow by the claims.

I claim:

1. A reversible foundation bolt holder comprising in combination:

a first grasping means including a means to releasably grasp a form supporting cementitious material, and a second grasping means connected to said first grasping means and including a means to releasably grasp a foundation bolt in an orientation desired to anchor the foundation bolt within the cementitious material;

wherein said first grasping means and said second grasping means are separated by an axis of symmetry such that said first grasping means and said second grasping means appear as mirror images of each other from a front view thereof; and wherein said first grasping means includes means to releasably grasp a foundation bolt, said foundation bolt grasping means of said first grasping means distinct from said foundation bolt grasping means of said second grasping means, and said second grasping means includes means to grasp the form;

whereby said foundation bolt holder is reversible through pivoting about said axis of symmetry.

2. The bolt holder of claim 1 wherein said first grasping means and said second grasping means include anti-skew means whereby the foundation bolt held therein is restrained from motion while the cementitious material hardens.

3. A reversible foundation bolt holder comprising in combination:

a first grasping means including a means to releasably grasp a form supporting cementitious material, and a second grasping means connected to said first grasping means and including a means to releasably grasp a foundation bolt in an orientation desired to anchor the foundation bolt within the cementitious material;

wherein said first grasping means and said second grasping means are separated by an axis of symmetry such that said first grasping means and said second grasping means appear as mirror images of each other from a front view thereof; and wherein said first grasping means includes means to releasably grasp a foundation bolt and said second grasping means includes means to grasp the form;

whereby said foundation bolt holder is reversible through pivoting about said axis of symmetry, and wherein said means to grasp a foundation bolt of said first grasping means and said second grasping means each include a distal plate and a proximal plate spaced apart, each said plate having a plurality of holes therein sized to receive foundation bolts, each said hole of said distal plate aligned, along a line substantially perpendicular to said distal plate and said proximal plate, with one of said holes of said proximal plate.

4. The bolt holder of claim 3 wherein said distal plates and said proximal plates each have two of said holes therein, each said hole located such that when one of said means to grasp the form is in place on the form each hole is a different horizontal distance from said form equal to one half of a width of a mudsill to be anchored by the foundation bolts oriented by said bolt holder, whereby said bolt holder provides two said holes for receiving foundation bolts therein with one said hole utilizable for a mudsill of one width and another said hole utilizable for a mudsill of another width without necessitating multiple bolt holders having different hole locations.

5. The bolt holder of claim 4 wherein said holes of said first grasping means are of a different size than said holes of said second grasping means, whereby said bolt holder can be reversed to orient holes of appropriate size to grasp a bolt of a desired size and position the bolt for fastening into the cementitious material.

6. The bolt holder claim 3 wherein said plates of said first grasping means are substantially parallel to each other and spaced a distance substantially equal to a width of the form and said plates of said second grasping means are substantially parallel to each other and spaced a distance substantially equal to a width of the form, said first grasping means and said second grasping means oriented such that when said first grasping means straddles the form, said second grasping means is located to support the foundation bolt, and when said second grasping means straddles the form, said first grasping means is located to support the foundation bolt.

7. The bolt holder of claim 6 wherein said plates of said first grasping means are substantially orthogonal to said plates of said second grasping means, whereby the bolt is maintained in an orientation parallel to the form.

8. The bolt holder of claim 6 wherein both said first grasping means and said second grasping means includes an orthogonal plate interposed orthogonally between said parallel plates of said first grasping means and said second grasping means, said orthogonal plates being attached to said parallel plates at ends thereof nearer said axis of symmetry, said orthogonal plates having ribs thereon extending within planes parallel to said parallel plates and between said parallel plates;

whereby said orthogonal plate of said first grasping means is elevated slightly above a top edge of the form when said parallel plates of said first grasping means straddle said form and said orthogonal plate of said second grasping means is elevated slightly above a top edge of the form when said parallel plates of said second grasping means straddle said form, thereby providing a space within which a lever may be placed to remove said bolt holder from the form.

9. The bolt holder of claim 8 wherein one of said parallel plates of said first grasping means and one of said parallel plates of said second grasping means includes a nail hole, whereby the bolt holder can be securely fastened to the form by locating a nail through said nail hole and into the form.

10. A bolt holder for supporting a foundation bolt in place within cementitious material of a building foundation during hardening thereof, comprising in combination:

a first straddle means to mount said bolt holder to a form supporting the cementitious material, and a first support means connected to said first straddle means supporting the foundation bolt in an orientation extending out of the cementitious material when said straddle means is mounted to the form, said first straddle means including two plates oriented in two planes spaced apart from each other with the plates on opposite sides of the form.

11. The bolt holder of claim 10 wherein said first straddle means includes a lever receiving means between the form and said bolt holder and between said two plates of said first straddle means, whereby said lever receiving means can receive a lever to pry said bolt holder off of the form.

12. A bolt holder for supporting a foundation bolt in place within cementitious material of a building foundation during hardening thereof, comprising in combination:

a first straddle means to mount said bolt holder to a form supporting the cementitious material, and a first support means connected to said first straddle means supporting the foundation bolt in an orientation extending out of the cementitious material when said straddle means is mounted to the form, and wherein said first straddle means includes two substantially parallel the plates spaced apart a distance similar to a width of the form with plates on opposite sides of the form.

13. A bolt holder for supporting a foundation bolt in place within cementitious material of a building foundation during hardening thereof, comprising in combination:

a first straddle means to mount said bolt holder to a form supporting the cementitious material, and a first support means connected to said first straddle means supporting the foundation bolt in an orientation extending out of the cementitious material, and wherein said first support means has a second straddle means integral therewith similar to said first straddle means and wherein said first straddle means has a second support means integral therewith similar to said first support means, whereby said apparatus may be reoriented with said second straddle means mounted to the form and said second support means supporting the foundation bolt.

14. A bolt holder for supporting a foundation bolt in place within cementitious material of a building foundation during hardening thereof, comprising in combination:

a first straddle means to mount said bolt holder to a form supporting the cementitious material, and a first support means connected to said first straddle means supporting the foundation bolt in an orientation extending out of the cementitious material, and wherein said first straddle means includes a lever receiving means between the form and said bolt holder, whereby said lever receiving means can receive a lever to pry said bolt holder off of the form, and wherein said lever receiving means is a plurality of ribs attached to said bolt holder and interposed between said bolt holder and the form, said ribs oriented parallel to a long axis of the form, whereby a space is provided between said bolt holder and a top surface of the form.

15. The bolt holder of claim 14 wherein said ribs are spaced sufficiently apart to provide two parallel gaps similar in size to claws of a claw hammer, whereby a claw hammer or similarly configured prying means may be utilized to easily remove said apparatus from the form.

16. A bolt holder for supporting a foundation bolt in place within cementitious material of a building foundation during hardening thereof, comprising in combination:

a first straddle means to mount said bolt holder to a form supporting the cementitious material, and a first support means connected to said first straddle means supporting the foundation bolt in an orientation extending out of the cementitious material, and wherein said first support means includes a distal plate and a proximal plate spaced apart with holes bored therethrough, said holes oriented such that each hole in said distal plate has a companion hole in said proximal plate, each hole and its companion hole residing along an axis of bolt alignment.

17. The bolt holder of claim 16 wherein said distal plate and said proximal plate are mutually parallel and spaced apart a distance equal to a width of the form, whereby said bolt holder is reorientable with said distal plate and said proximal plate straddling the form.

18. The bolt holder of claim 17 wherein said first straddle means has a second support means supporting the foundation bolt when said bolt holder is reoriented with said distal plate and said proximal plate straddling the form.

19. A reversible foundation bolt holder comprising in combination:

a first grasping means, and a second grasping means attached to said first grasping means, each said grasping means including means to attach to a single form supporting cementitious material, said attachment means alone supporting said bolt holder, and each said grasping means including means to support a foundation bolt within the cementitious material, whereby said bolt holder can utilize said first grasping means to attach to the form and said second grasping means to support the foundation bolt or utilize said second grasping means to attach to the form and said first grasping means to support the foundation bolt.

20. The bolt holder of claim 19 wherein each said attachment means of each said grasping means includes two plates spaced apart from each other.

21. The bolt holder of claim 20 wherein each said plate of each said attachment means includes a plurality of holes therein sized to receive foundation bolts therethrough, each said hole aligned with another hole of an opposite plate of said attachment means.

* * * * *